US009872549B2

(12) United States Patent
Kock

(10) Patent No.: US 9,872,549 B2
(45) Date of Patent: Jan. 23, 2018

(54) HAIR STYLING DEVICE

(71) Applicant: WIK Far East Ltd., Hong Kong (CN)

(72) Inventor: Marwin Kock, Essen (DE)

(73) Assignee: WIK Far East Ltd., Hong Kong (CN)

( * ) Notice: Subject to any disclaimer, the term of this patent is extended or adjusted under 35 U.S.C. 154(b) by 0 days.

(21) Appl. No.: 14/465,249

(22) Filed: Aug. 21, 2014

(65) Prior Publication Data

US 2015/0237983 A1 Aug. 27, 2015

(30) Foreign Application Priority Data

Jul. 22, 2013 (DE) ..... 20 2013 103 275 U

(51) Int. Cl.

| | |
|---|---|
| ***A45D 6/06*** | (2006.01) |
| ***A45D 1/04*** | (2006.01) |
| ***A45D 1/06*** | (2006.01) |
| ***A45D 1/08*** | (2006.01) |
| ***A45D 2/00*** | (2006.01) |

(52) U.S. Cl.

CPC ..... *A45D 1/04* (2013.01); *A45D 1/06* (2013.01); *A45D 1/08* (2013.01); *A45D 2/001* (2013.01)

(58) Field of Classification Search

CPC ... A45D 1/00; A45D 1/02; A45D 1/04; A45D 1/06; A45D 1/08; A45D 1/14; A45D 1/28; A45D 2/26; A45D 2/001

See application file for complete search history.

(56) References Cited

U.S. PATENT DOCUMENTS

| | | | | |
|---|---|---|---|---|
| 1,449,632 A * | 3/1923 | Talbot | ..... | A45D 1/04 132/225 |
| 1,539,313 A * | 5/1925 | Homer | ..... | A45D 1/06 132/263 |
| 4,354,092 A | 10/1982 | Manabe et al. | | |
| 5,941,253 A | 8/1999 | Kaizuka | | |
| 6,070,596 A | 6/2000 | Altamore | | |

(Continued)

FOREIGN PATENT DOCUMENTS

| | | |
|---|---|---|
| FR | 2967020 B1 | 12/2012 |
| FR | 2988272 A1 | 9/2013 |

(Continued)

OTHER PUBLICATIONS

Search report dated Apr. 25, 2017 in related French application 1401681.

*Primary Examiner* — Rachel Steitz

(74) *Attorney, Agent, or Firm* — Polson Intellectual Property Law, PC; Margaret Polson

(57) ABSTRACT

A hair styling device comprising two hinged arms able to move relative to each other for the receiving and shaping of a strand of hair. Each arm carries a shaping plate on its side facing the other arm. These shaping surfaces making contact with the hair strand being styled. The hair being styled is pulled past these shaping surfaces. One of the two arms has a hair support on its side carrying the shaping plate. The hair support is arranged at a spacing from the shaping surface of the other arm, so that the other arm can be introduced into an arm support between the hair support and the shaping surface of the shaping plate of the arm carrying the hair support. The shaping plates of the two arms which cooperate with each other for the hair styling can move relative to each other in the manner of scissors.

7 Claims, 6 Drawing Sheets

(56) References Cited

U.S. PATENT DOCUMENTS

| | | | | |
|---|---|---|---|---|
| 6,278,086 | B1 | 8/2001 | Janouch et al. | |
| 6,627,852 | B1 | 9/2003 | Savone | |
| 6,895,975 | B2 | 5/2005 | Hafemann | |
| 7,124,763 | B2 | 10/2006 | Hafemann | |
| 8,096,307 | B2 | 1/2012 | Hafemann | |
| 2003/0145871 | A1 | 8/2003 | Hafemann | |
| 2004/0251245 | A1 | 12/2004 | Oh | |
| 2005/0081876 | A1 | 4/2005 | Choi | |
| 2006/0191554 | A1 | 8/2006 | Lafuente | |
| 2008/0041409 | A1 | 2/2008 | Leung | |
| 2009/0014024 | A1* | 1/2009 | Wong | A45D 1/12 132/225 |
| 2009/0260650 | A1 | 10/2009 | Jung | |
| 2010/0147323 | A1 | 6/2010 | Hafemann | |
| 2013/0112221 | A1 | 5/2013 | Kock | |
| 2014/0033558 | A1* | 2/2014 | Richmond | A45D 20/10 34/97 |
| 2014/0238432 | A1 | 8/2014 | Deng | |
| 2015/0047667 | A1 | 2/2015 | Mandica et al. | |
| 2015/0150350 | A1 | 6/2015 | Kock | |

FOREIGN PATENT DOCUMENTS

| | | | |
|---|---|---|---|
| JP | 2004267787 | | 9/2004 |
| WO | 2005067760 | A1 | 7/2005 |
| WO | 2013104903 | A3 | 7/2013 |
| WO | 2014151728 | A2 | 9/2014 |
| WO | 2015071656 | A1 | 5/2015 |

* cited by examiner

*Stand der Technik*

HAIR STYLING DEVICE

CROSS REFERENCE APPLICATIONS

This application claims the benefit of German Application Number: 20 2013 103 275.1 filed Jul. 22, 2013.

BACKGROUND

The invention concerns a hair styling device with two hinged arms able to move against each other for receiving and shaping a strand of hair. Each arm carries a shaping plate facing the other arm during the hair styling process. A shaping surface is in contact with the hair strand being styled while the hair being styled is pulled past these shaping surfaces.

Hair curls or waves can also be shaped with a so-called "straightening iron". Such a hair styling device is customarily used for the straightening of hair and has two arms articulated against each other like a set of pliers. Each arm carries a shaping plate on its side facing the other arm. Normally both shaping plates are heated with one or more electric heating elements. Typically PTC heating elements and/or a flow of hot air is used for the heating of a shaping plate. Between the shaping plates there is a hair styling space, which can be opened or closed using the articulated arrangement of the arms. The shaping plates are outfitted with a level surface on their side facing the hair styling space. To straighten out hair, it is pulled through the closed hair styling space. The temperature applied to the hair help enable the straightening process. Such hair styling devices are also used to form curls or waves. This is possible because the arms of such a hair styling device are approximately semicircular or semielliptical in cross section and the heated hair can be wound around the outer sides of the closed arms. In such a usage, the straightener is used in the manner of a curling iron. The outer sides of the arms then function as shaping bodies.

The hinged connection of the two arms allows them to be moved relative to each other, while the shaping surfaces remain in a flush arrangement facing each other. If the shaping surfaces are moved away from each other by displacement of the arms, a strand of hair can be placed between the opposing shaping plates. The arms are then brought back to their closed position and shaping surfaces act on the hair strand placed between them. In order to curl or wave a strand of hair it must be pulled through the hair styling space by using the outer side of an arm. After inserting the strand of hair it is necessary to turn the hair styling device at least 90° (but usually more than 120°) while the strand of hair needs to be moved past the outer side of the shaping body in order to produce the desired styling.

Even though the outer sides of both arms of such hair styling devices can be designed as shaping bodies (so that after grasping a strand of hair the styling of a curl or a wave can be done regardless of the direction of rotation used), this has the drawback that the curling or waving has a different sense of rotation depending on the direction of rotation of the device. Normally the curling or waving effect on the many strands of hair should all be done with the same sense of rotation. A complicating factor in the manipulating of such hair styling devices is that when used on yourself the procedure is done in front of a minor, such that your own movements can only be seen in reverse image through the minor.

Starting from this prior art, the problem of this invention is therefore to modify the above mentioned hair styling device so that it can be manipulated for the styling of curls or waves primarily in regard to a styling with the same sense of rotation.

SUMMARY

This problem is solved by the invention of a hair styling device similar to the kind mentioned at the outset in which one of the two arms has a hair support on its side carrying the shaping plate. This hair support is arranged at a distance from the shaping surface of the arm, so that the other arm can be introduced into an arm holder between the hair support and the shaping surface of the shaping plate of the arm carrying the hair support. The shaping plates of the two arms cooperate for the hair styling and can be moved relative to each other in the manner of scissors.

Unlike the previously known hair styling devices of this kind, in the present disclosure the two arms can move relative to each other in the manner of scissors. This means that the two arms are moved relative to each other in the plane of the shaping surfaces or at least with a substantial vectorial component situated in this plane. In the prior art the swivel axis of these arms is located in the plane of the shaping surfaces. In the present disclosure the swivel axis is at an angle to the plane of the shaping surfaces, and works well with an angle larger than 70°. Additionally, one of the two arms carries a hair support. This hair support is spaced apart from the side of the arm which carries the shaping plate such that the other arm can fit between the hair support and the arm carrying the hair support. The hair support typically extends parallel to and at least along the lengthwise dimension of the shaping plate of this arm. Due to the above-described scissors-like movement ability of the two arms of this hair styling device relative to each other, the arm not carrying the hair support can be swiveled out from its position of use when its shaping surface is bordering on the shaping surface of the other arm. The swivel ability is such that a strand of hair can be placed on the hair support and the side of the arm carrying the hair support that is at a distance from it. The strand of hair is then supported at two points. When the other second arm is swiveled back into its position of use relative to the first arm carrying the hair support, the strand of hair located on the above described supporting arrangement will be pulled along with this arm into the closing hair styling gap. By this process the strand of hair is automatically placed against the outer side of the arm closing the hair styling gap. If the arms of this hair styling device with a strand of hair already drawn into them are closed, the strand of hair is in the designed position resting against the outer side of an arm. This means that it is no longer necessary to turn the hair styling device in order to place the hair being styled against the outer side of an arm serving as a shaping body. Consequently handling is easier, which is particularly noticeable when a person is styling their own hair while using a mirror.

An especially advisable configuration is one in which the plane of the shaping surfaces of the shaping plates of the two arms is inclined relative to the plane of movement of the arms. An arrangement of the planes of the shaping surfaces with a larger angle of inclination means that the placement of the strand of hair being styled against the outer side of the one arm serving as a shaping body only extends for a smaller angular magnitude. Typically, one wants to use the outer side of the arm as much as possible as a shaping contour.

The outer side of the arm not carrying the hair support is either shaped accordingly or has corresponding elements on which a strand of hair pulled across and previously heated between the shaping plates can be brought to the desired shape. An especially effective hair styling can be accomplished with the described hair styling device when the arm used for the shaping carries on its outer side several shaping bodies arranged at an appropriate spacing from each other, from the outer termination of the housing of this arm, and extending in the longitudinal dimension of the arm. With this configuration, a user can preform a hair styling method where first the hair being styled is heated enough so that the sulfur bonds contained in the keratin chains of the hair are at least mostly broken up. Then the hair styling is accomplished by pulling the heated hair past several spaced-apart shaping bodies while making contact with them such that at least upon contacting the first shaping body the hair still has a temperature at which the sulfur bonds are mostly not yet reformed. The shaping bodies are arranged relative to each other so that the path of movement of the hair being pulled past the shaping bodies corresponds to an approximately curved path. Before leaving the last hair shaping body the hair has cooled to a temperature at which the broken sulfur bonds are already mostly reformed again, completing the procedure.

In this method, the hair is heated enough so that the sulfur bonds contained in the keratin chains and joining the protein strands to each other are, for the most part broken up. In this state the hair is brought into shape, held in shape, and then cooled down so that the altered shape of the hair is "frozen in". This is achieved because the sulfur bonds reform during the shaping process and thus reconnecting the protein strands according to the shaping of the hair. The hair is virtually quenched after its shaping since the hair being curled or waved is pulled past the shaping bodies such that upon leaving contact with the last shaping body in the pulling direction the hair has already cooled down to a temperature at which most of the sulfur bonds have reformed. It is not necessary for the hair to be cooled down to room temperature. Instead, it has been found that cooling the hair only to a temperature at which the sulfur bonds reconnect is sufficient to achieve a longer lasting hair styling than traditional methods. The above described result was surprising, since the prevailing view assumed that a cool down of a curl shaped on a curling iron to a much lower temperature level was necessary in order to obtain the desired curling or waving. The fast cooling of the hair on the same device that was used to style the hair ensures that most of the sulfur bonds have already reformed to freeze in the styling before the hair is again subjected to a tensile stress as a result of the pulling process needed to manipulate it. This unavoidable tensile stress on the styled hair is therefore without any significant influence on the styled hair.

The shaping bodies are spaced apart from each other in relation to the trajectory of movement of the hair contacting and moving past them in order to make this rapid cool down possible. This makes possible a dissipation of heat from the hair in the radial direction in relation to the curved path traveled by the hair to the outside in the gaps between the shaping bodies and also, inward in the direction of the arms carrying the shaping bodies. Thus, the shaping bodies form supports across which the heated hair is pulled. Accordingly, the hair is free hanging between the shaping bodies serving as supports and does not lie against the surface of a body. The trajectory of the hair starting from the exit of the hair styling gap and until leaving contact with the last shaping body constitutes the curved path. Depending on the shape of the curved path, i.e., depending on the arrangement of the shaping bodies to each other, a larger or smaller curl can be formed. The curved path is also influenced by the number of shaping bodies provided. By pulling the hair being styled past the shaping body while in contact with it, the hair is held in the desired shape as the pulling continues until the cooldown process has advanced enough that most of the sulfur bonds have reformed thereby fixing the shape.

In one simple embodiment of a hair styling device to carry out the above-described method, the edge of the arm adjoining the shaping plate can also serve as a shaping body on the side where the heated hair emerges from the hair styling gap. This edge is advisedly rounded. Then only one additional shaping body is needed in order to move the hair in the described manner and keep it at a distance from the housing of the arm. However, it is advised that several shaping bodies still be used, typically three to five, for a better and longer formation of the curved path. It is entirely possible to use the described edge of the arm likewise as a shaping body in the above described manner.

Preferably the method will be designed so that the hair has cooled down by at least 10° C. upon leaving the last shaping body, and most preferably by even more than 15° C. to 20° C. below the temperature at which the sulfur bonds contained in the keratin chains of the hair are broken. Depending on the texture of the hair being styled this temperature can be regulated by a heating adapted to the texture or the hair and/or the speed of the pulling with which the hair styling device is moved through the hair. The process can also be influenced through the pressure exerted on the hair situated in the hair styling gap between the two shaping plates of the arms.

A current of air can serve to support the cool down.

A cool down of the hair is especially effective if the shaping bodies are only supported at single points and thus a free space is present on the side of the shaping body facing the arm. This not only accomplishes a cool down of the hair through the shaping bodies which can give off heat in this direction, but also an air exchange in the region between the hair being moved around this arm of the hair styling device or the strand of hair being moved around this arm of the hair styling device and the outside of the housing itself. The pulling process itself ensures a swirling of the air and thus an air exchange between the hair and the outer side of the arm carrying the shaping body. This air swirling takes away the heat given off by the hair and supplies cool room air to it.

According to one sample embodiment, the shaping bodies are configured as rods. Basically, the shaping bodies can have a different cross sectional geometry in the pulling direction of the hair, especially if they border on a free space on their side facing the arm. Thus for example, the last shaping body in contact with the hair can have a larger contact surface with the hair in order to produce a last negative temperature swing by abstraction of heat. Such a shaping body also advisedly has a relatively larger heat transfer surface, such as in the manner of one or more cooling fins. Typically at least the first shaping body or bodies are designed and arranged so that the hair moving past and in contact with them, has not yet cooled below the temperature at which the sulfur bonds have reformed in order to reconfigure the keratin chains in accordance with the desired styling.

The invention shall be described below by means of sample embodiments, making reference to the enclosed figures. Further benefits of the invention will emerge from them. There are shown:

DETAILED DESCRIPTION OF THE DRAWINGS

Figure 1:
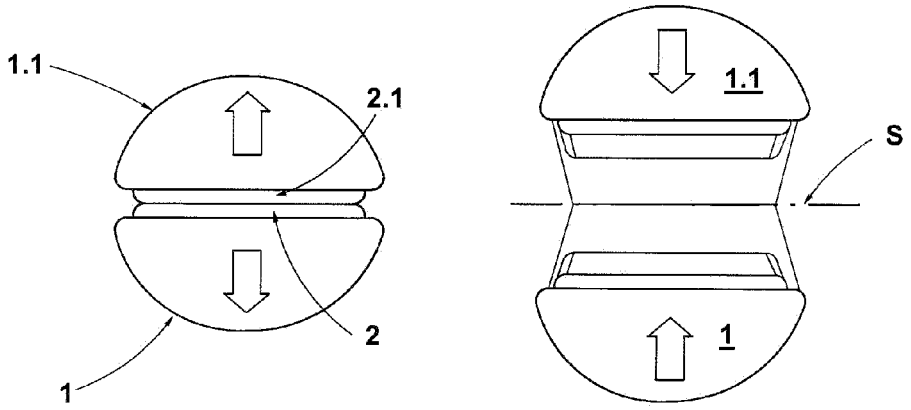
FIGS. 1*a* and 1*b* are a schematized representation of the hinged movement capability of the arms of a hair styling device according to the prior art.

Referring first to FIGS. 1*a* and 1*b*, a so-called straightener type hair styling device of the prior art has two arms 1, 1.1. On the sides of the arms facing each other there is one shaping plate 2, 2.1 apiece. The shaping plates 2, 2.1 are heated. In order to receive a strand of hair, which is heated on the heated shaping plates by being pulled past them, the two arms 1, 1.1 can move relative to each other in the manner of a set of pliers, as is shown by the block arrows in FIGS. 1 and *b*. In open position of the two arms 1, 1.1 of this hair styling device, shown in FIG. 1*b*, t, a strand of hair is placed into the opened hair styling gap located between the shaping plates 2, 2.1. Next, the arms 1, 1.1 are closed to perform the hair styling process. The swivel axis of the articulated connection of the two arms is situated in the plane of the shaping surfaces produced by the shaping plates 2, 2.1. This is indicated as S in FIG. 1*b*.

Figure 2:
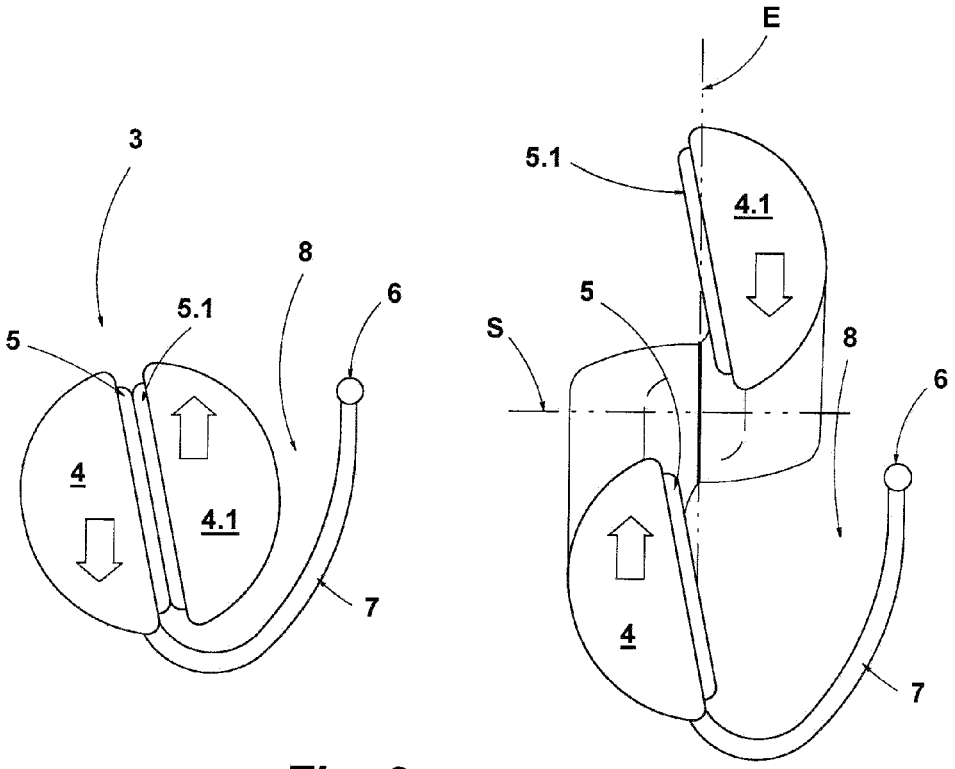
FIGS. 2*a* and 2*b* are a schematized representation of the hinged movement capability of the arms of a hair styling device according to the invention.

Referring next to FIGS. 2*a* and *b*, a hair styling device 3 according to the invention likewise has two arms 4, 4.1 each with a shaping plate 5, 5.1 heated by one or more heating elements. In the closed position seen in FIG. 2*a*, the hair styling device 3 does not differ in regard to the positioning of the facing, parallel shaping surfaces of the shaping plates 5, 5.1 from the closed position of a hair styling device of the prior art. The hair styling device 3 differs for the prior art in regard to the articulated connection of its two arms 4, 4.1. In the hair styling device 3, the arms 4, 4.1 are articulated like scissors as seen in FIG. 2*b*. This means that the two arms 4, 4.1 move relative to each other in the manner of a pair of scissors for opening and closing the hair styling gap. Therefore, the plane of movement in which the two arms move relative to each other is situated essentially transversely to the plane of the shaping surfaces of the shaping plates 5, 5.1. In the sample embodiment shown, the shaping surfaces of the shaping plates 5, 5.1 are inclined relative to the plane of the movement path E at an angle of around 10°. The swivel axis in FIG. 2*b* is likewise designated as S. The articulated movement capability of the two arms 4, 4.1 relative to each other is especially evident from the contrasting representation of the closed position (FIG. 2*a*) and the open position of the hair styling device 3 (FIG. 2*b*). The inclined orientation of the shaping surfaces of the shaping plates 5, 5.1 with respect to the movement path E of the arms 4, 4.1 means that the hair styling gap can be opened and closed according to the inclination. This also has the result that a certain pressure can be exerted on the strand of hair placed in the hair styling gap between the shaping plates 5, 5.1.

The arm 4 carries a hair support 6 configured as a rod. The hair support 6 in the depicted embodiment is a metal rod. The hair support 6 is joined by a bracket 7 to the arm 4 of the hair styling device 3. Accordingly, the hair support 5 with the supporting bracket 7 and the arm 4 forms an arm support 8. The arm support 8 serves to receive the arm 4.1 in the closed position of the hair styling device. For this reason, the spacing between the hair support 6 and the arm 4 is correspondingly large. In order not to impair the ease of handling of the hair styling device, one will generally select this spacing to be only slightly larger than is actually required for the fitting of the arm 4.1. The hair support 6 extends parallel to the longitudinal dimension of the shaping plate 5 also along its length. In the position of the hair styling device 3 shown in FIG. 2, the upper edge of the hair support 6 is roughly in the same plane as the upper termination of the arm 4 pointing in this same direction.

Figure 3:
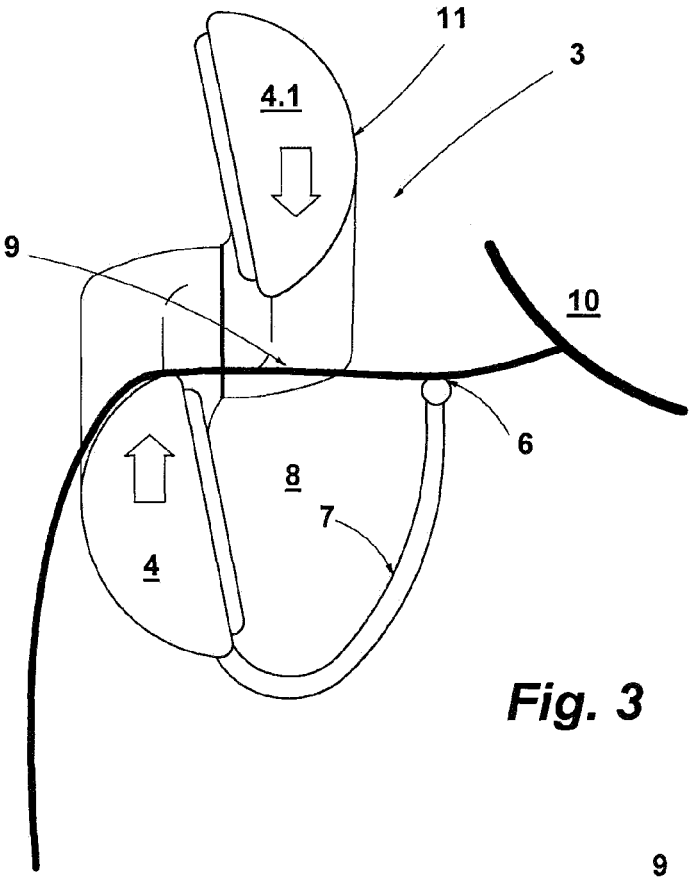
FIG. 3 shows the hair styling device of FIG. 2 in its open position to receive a strand of hair for styling.

FIG. 3 shows schematically the hair styling device 3 in its open position during the process of receiving the strand of hair 9 being styled. In this open position, the top side of the hair support 6 and the side of the housing of the arm 4 pointing toward the other arm 4.1 each subtend a support for a strand of hair 9. Thus, the strand of hair 9 spans the arm support 8 enclosed by the bracket 7 by a two-point support system. The head itself is indicated by reference 10 in FIG. 3.

Figure 4:
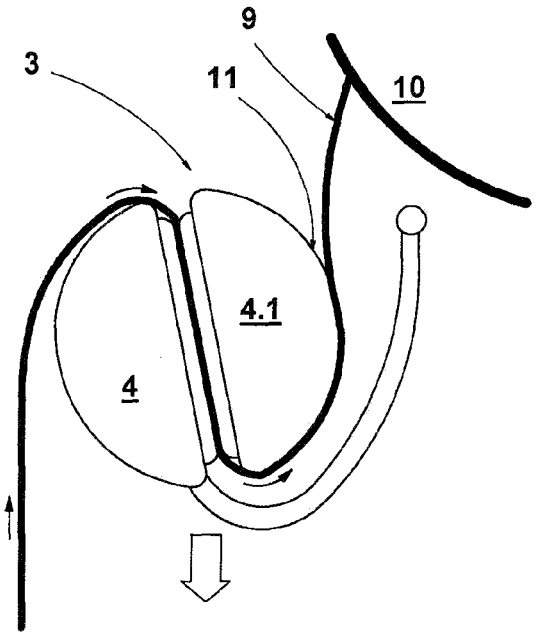
FIG. 4 again shows the hair styling device of FIG. 3 with strand of hair taken up during the hair styling process.

Now, if the hair styling device 3 is closed for purposes of the styling process, the arm 4.1 is introduced into the arm support 8 by swiveling it relative to the swivel axis S with respect to the arm 4 as seen in FIG. 4. With this movement, the strand of hair 9 will also be drawn into the arm support 8 and laid during this process around the outer side 11 of the arm 4.1 or across a segment of the outer side 11. The outer side 11 of the arm 4.1 is configured to thereupon perform a hair styling, and therefore it is designed as a shaping body or carries one or more shaping bodies for this purpose.

If the hair styling gap is closed between the shaping plates 5, 5.1, as is shown in FIG. 4, the hair styling process can occur by corresponding pulling of the strand of hair through the hair styling gap of the hair styling device 3 and automatic pulling of the heated strand of hair 9 along the outer side 11 of the arm 4.1.

It is an advantage that the temperature management of the hair styling device 3 is designed so that the method described in the introduction of the specification is carried out for purposes of a long-lasting hair styling. In the embodiment depicted in the figures, the edge of the housing of the arm 4.1 pointing downward and extending parallel to the shaping plate 5.1 serves primarily as the shaping body. What is important in this process is that the strand of hair 9 only leaves the outer side 11 of the arm 4.1 when the sulfur bonds in the keratin chains of the hair have reformed in accordance with the external configuration of the arm 4. Since when the strand of hair 9 is pulled along the outer side a greater tensile force prevails than on the inner side in contact with the outer side 11 of the arm 4.1, the keratin chains of the hair will be connected accordingly by means of their sulfur bonds so that the waving or curling is especially long lasting.

Figure 5:
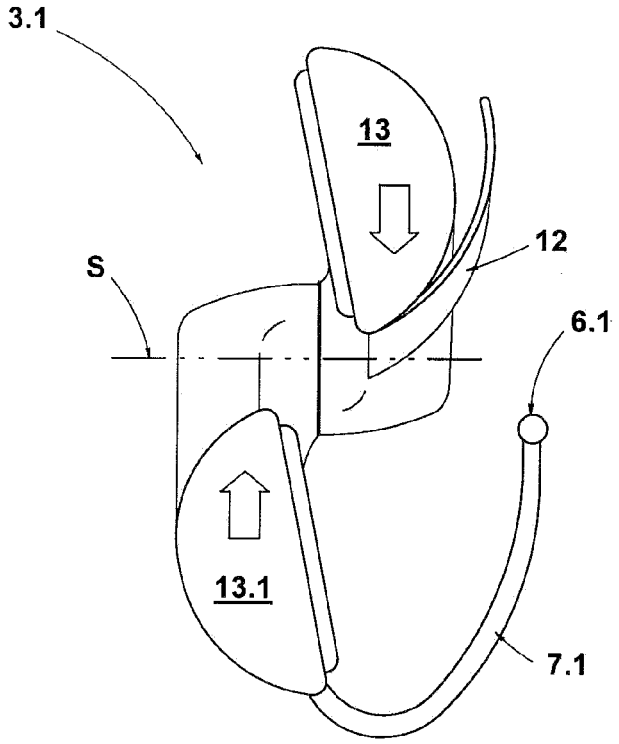
FIG. 5 is a hair styling device according to another embodiment of the invention.

As shown in FIG. 5, in another embodiment a hair styling device 3.1, has a cooling body 12 to support the cooling process. In the depicted embodiment shown in FIG. 5 the cooling body 12 is arranged at the arm 13 of the hair styling device 3.1 not carrying the hair support 6.1. The arm carrying the hair support 6.1 is indicated by reference number 13.1. The cooling body 12 is a sheet metal strip, along which is pulled the hair heated and drawn out from the hair styling gap. A cooling at the cooling body 12 occurs more quickly than merely at the outer side of the arm 13, as is described for the sample embodiment of FIGS. 2 to 4.

Figure 6:
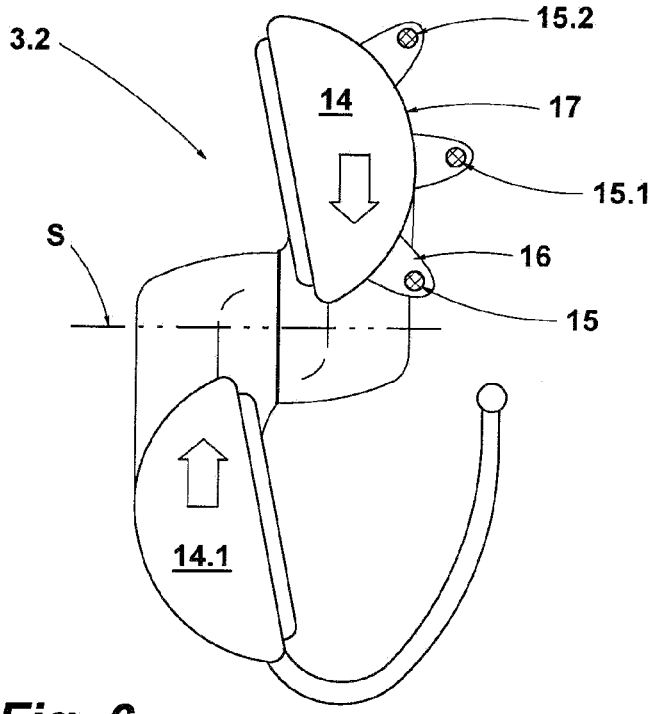
FIG. 6 is a hair styling device according to yet another embodiment of the invention.
Figure 7:
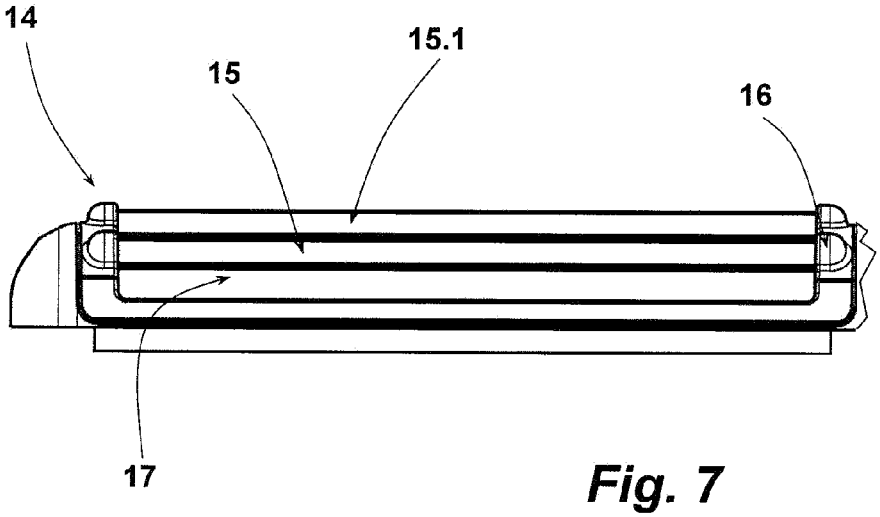
FIG. 7 shows a side view of the one arm of the hair styling device of FIG. 6.

FIGS. 6 and 7 show yet another sample embodiment of a hair styling device 3.2 according to the invention. Unlike the arm 13 of the hair styling device 3.1, the arm 14 of this hair styling device carries on its outer side, several cooling bodies. In the present instance those three cooling bodies are 15, 15.1, 15.2. The cooling bodies 15, 15.1, 15.2 are designed as metal rods and are each held at their ends in a trestle 16. For clarity, only the trestle 16 of the cooling body 15 is identified with a reference number in this regard. Like the cooling body 12, the cooling bodies 15, 15.1, 15.2 extend in their longitudinal dimension parallel to the outer side of the respective arm 13 or 14 and in their length at least across the longitudinal dimension of the shaping plate of this arm 13 or 14. The cooling bodies 15, 15.1, 15.2 are arranged with a spacing from each other and also with a spacing from the surface 17 of the arm 14. Thus, a strand of hair pulled across the outer vertex of the cooling bodies 15, 15.1, 15.2 as shown in FIG. 4 can give off heat in the radial direction to the outside and to the inside in the direction of the surface 17. This provides for especially effective cooling. FIG. 7 shows the arm 14 of the hair styling device 3.2 in a side view. The longitudinal dimension of the cooling bodies 15, 15.1 is distinctly recognizable.

The depicted embodiments of the hair styling devices 3.1 and 3.2 are especially suited to carrying out the above-described special hair styling method. According to which a strand of hair being styled is heated to a temperature at which the sulfur bonds joining the keratin chains and thus also the hydrogen and salt bonds present are broken up due to the heating and whereby a strand of hair only leaves the cooling body or the arrangement of cooling bodies when it has cooled down to a temperature at which the sulfur bonds have at least already reformed. Preferably, the strand of hair has cooled down enough so that the hydrogen and salt bonds have also already reformed before the strand of hair leaves the last cooling body or the last in an arrangement of cooling bodies.

Figure 8:
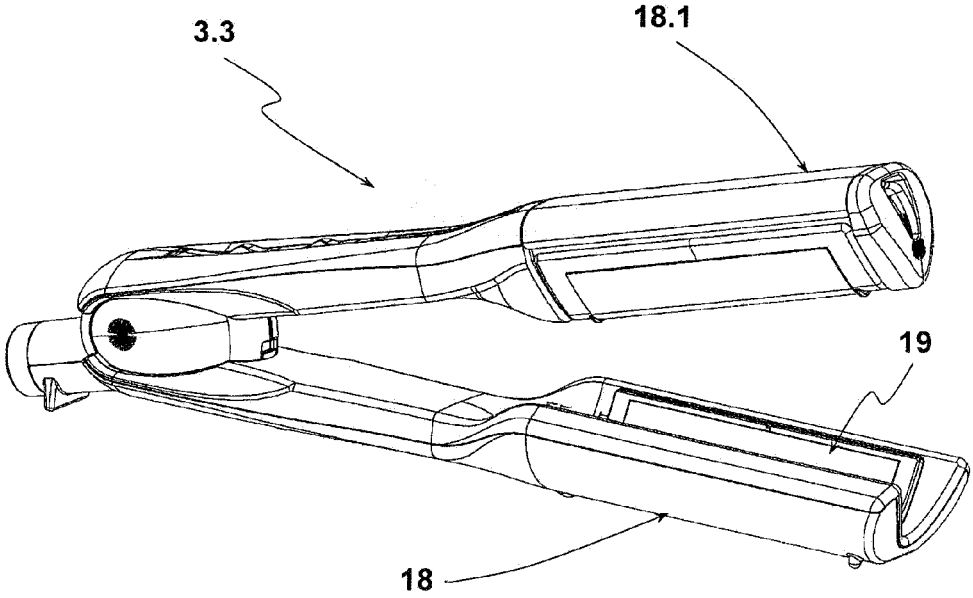
FIG. 8 shows a hair styling device according to the invention in another embodiment in a perspective view.
Figure 9:
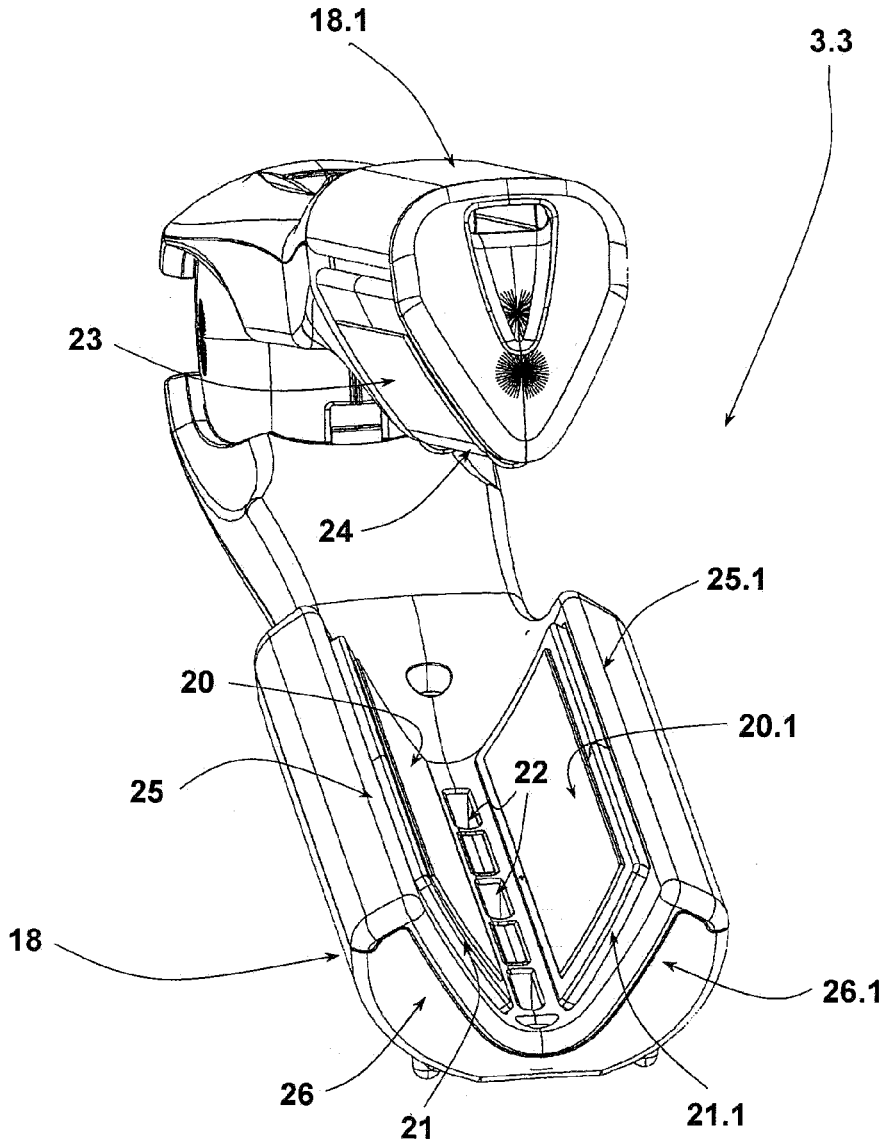
FIG. 9 shows the hair styling device of FIG. 8 from a perspective looking into the arm support of the one arm of the hair styling device and FIG. 10 is a perspective view of the hair styling device of FIGS. 8 and 9 with closed arms.

FIG. 8 shows in perspective view another hair styling device 3.3 which works by the same principles as the hair styling devices 3, 3.1, 3.2 described in the preceding sample embodiments. The hair styling device 3.3 constitutes a further modification of the above-described hair styling devices, being designed double-sided. The hair styling device 3.3 likewise has two arms 18, 18.1, which are hinged and can move relative to each other. In the representation of FIG. 8, the hair styling device 3.3 is shown with the arms 18, 18.1 opened. The arm 18 has an arm support 19. The arm support 19, as better shown in FIG. 9, is V-shaped. The arm support 19 is enclosed on both sides and thus by the legs of the arm support 19 by one shaping surface 20, 20.1 apiece. The shaping surfaces 20, 20.1 each constitute the surface of a shaping plate 21, 21.1 used for the hair styling. At least one of the shaping plates 21, 21.1 is heated during the operation of the hair styling device 3. In the region of the vertex of the arm support 19, the shaping plates 21, 21.1 are separated from each other. In this spacing region of the vertex, several apertures 22 are arranged in series and following the longitudinal dimension of the arm support 19. The apertures 22 reach through the arm 18.

The arm 18.1 carries complementary shaping surfaces 23, FIG. 9 showing only the complementary shaping surface 23 to the shaping surface 20. On the side of the arm 18.1 not visible in FIG. 9 there is also a shaping surface complementary to the shaping surface 20.1. The two shaping surfaces 23 of the arm 18.1 pass flush into each other to form a radius produced by a vertex 24. The shaping surfaces 20, 20.1 and 23 are arranged so that when the arms 18, 18.1 are closed they enter into contact with each other. When the hair styling device 3.3 is in use, the strand of hair being styled is located between the shaping surfaces 20, 20.1, 23. As in the case of the hair styling devices 3, 3.1, 3.2, the shaping surfaces 20, 20.1 of the one arm—arm 18—move with respect to the shaping surfaces of the other arm—arm 18.1—in the manner of a scissors. The shaping surfaces 20, 20.1 are inclined with respect to each other for this purpose, just like the shaping surfaces 23 with respect to the swivel axis of the two arms 18, 18.1, and just as was described in the preceding sample embodiments of the hair styling devices 3, 3.1, 3.2.

The representation of the hair styling device 3.3 in FIG. 9 makes it clear that the upper termination 25, 25.1 of each arm piece 26, 26.1 carrying a shaping plate 20 or 20.1 forms the hair support for the respective other arm piece 26.1 or 26 so as to introduce a strand of hair into the arm support 19 in the same way as was already described for the previous sample embodiments.

Figure 10:
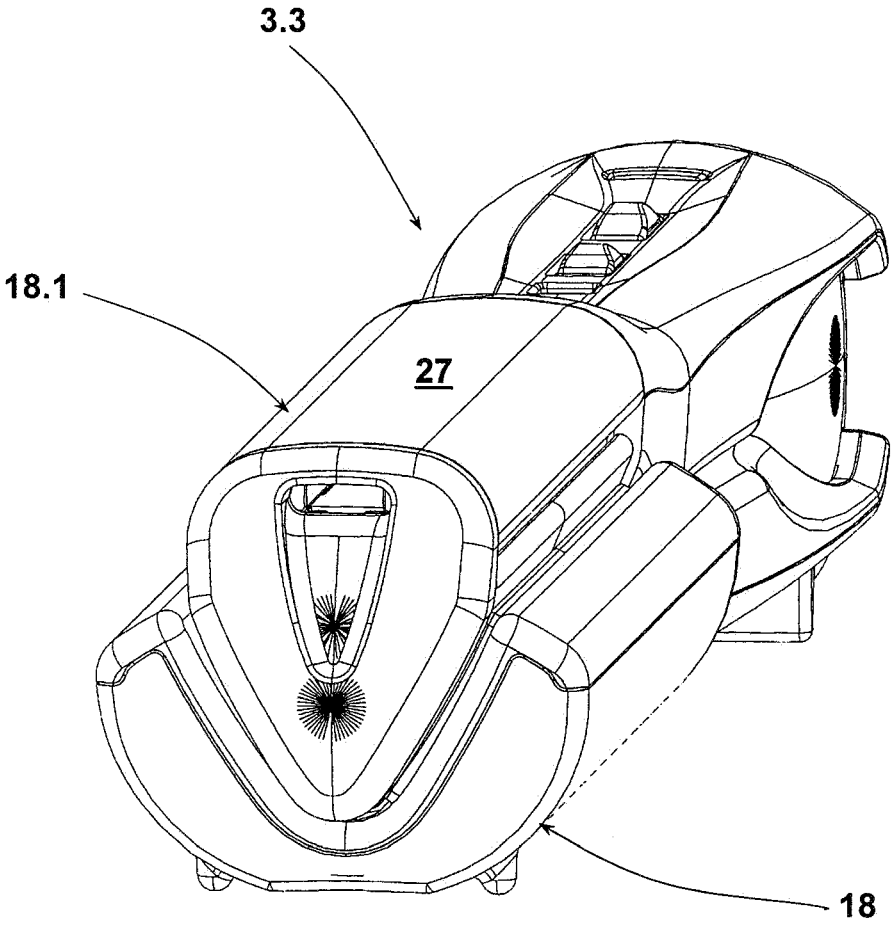

FIG. 10 shows the hair styling device 3.3 with closed arms 18, 18.1. This position of the two arms 18, 18.1 forms the hair styling position. The arm 18.1 with its shaping surfaces 23 is introduced into the arm support 19. The shaping surfaces 23 of the arm 18.1 lie against the complementary shaping surfaces 20 or 20.1 of the shaping plates 21 or 21.1 of the arm 18.

The top side of the arm 18.1 shown in FIG. 10 is outfitted with a cooling surface 27. This serves the purpose of cooling the hair which is drawn through the arm support 19 and then moved across the surface 27 making contact, in the manner already described for the previous sample embodiments with the cooling body.

It is an advantage of the hair styling device 3.3 that it can be turned in both directions for the curling of hair.

In one possible embodiment for heating the shaping surfaces 23 of the arm 18.1 these work together and one or more Peltier elements are used for the heating. This concept works because it is enough for the desired hair styling to heat only one pair of shaping surfaces. Here for example, the shaping surfaces 20 and 23. Thus, with the hair styling device 3.3, the non-heated shaping surface 23 of the arm 18.1 can operate as a cooling surface. Accordingly, with such a manner of operation, the power consumption is also reduced. Since this way the heat which is taken away from the hair via the one non-heated shaping surface of the arm 18.1 is used for heating the other shaping surface.

The invention has been described by means of sample embodiments making reference to the figures. Many other possible configurations will be apparent to the skilled person for implementing the invention in the framework of the asserted claims.

LIST OF REFERENCE SYMBOLS

1, 1.1 Arm
2, 2.1 Shaping plate
3, 3.1, 3.2 Hair styling device
4, 4.1 Arm
5, 5.1 Shaping plate
6 Hair support
7 Bracket
8 Arm support
9 Hair strand

10 Head
11 Outer side
12 Cooling body
13, 13.1 Arm
14, 14.1 Arm
15, 15.1, 15.2 Cooling body
16 Trestle
17 Surface
18, 18.1 Arm
19 Arm support
20, 20.1 Shaping surface
21, 21.1 Shaping plate
22 Aperture
23 Shaping surface
24 Vertex
25, 25.1 Upper termination/hair support
26, 26.1 Arm piece
27 Cooling surface
E Movement plane
S Swivel axis

The invention claimed is:

1. A hair styling device having a first and second arm hinged to move against each other for receiving and shaping a strand of hair, the hair styling device comprising:

each of said first and second arm having a heated shaping plate on a side of the arm facing the other arm during the hair styling;

each of said heated shaping plate having a shaping surface which is heated and in contact with a hair strand being styled for a hair styling process, wherein the shaping surfaces of the heated shaping plates are substantially parallel in a dosed position of the hair styling device to at least one shaping surface of the heated shaping plate of the opposite arm, and the hair being styled is pulled past these shaping surfaces during the hair styling process;

the first arm having a non-heated hair support spaced apart from the side carrying the heated shaping plate such that a strand of hair to be curled is supported on at least two points before the second arm is closed, the two points being part of the first arm and the non-heated hair support;

said non-heated hair support being spaced apart from the shaping surface of said first arm, such that the second arm can be introduced into an arm support between the non-heated hair support and the shaping surface of the heated shaping plate of the first arm carrying the non-heated hair support pulling a hair strand down onto the heated shaping plate; and the heated shaping plates of the two arms can be moved relative to each other in the manner of a scissors, wherein the shaping surfaces of the heated shaping plates have an inclined orientation relative to a movement path of the two arms, wherein the arm support is V-shaped or nearly so in cross section and both legs of this arm support have at least part of the shaping surface, and the termination of each leg of this arm support facing the second arm forms the non-heated hair support for the opposite leg in relation to the arm support, and the first arm carries two shaping surfaces which are configured complementary the shaping surfaces of the second arm.

2. The hair styling device of claim 1, wherein in a plane of the shaping surfaces of the two arms, the shaping surfaces are tilted with respect to a movement plane of the arms for their articulated movement.

3. The hair styling device of claim 2, wherein an angle of inclination of the shaping surfaces of the two arms with respect to the movement plane of the arms is inclined relative to each other by at most 20°.

4. The hair styling device of claim 2, wherein an angle of inclination of the shaping surfaces of the two arms with respect to the movement plane of the arms is inclined relative to each other by not more than 10°.

5. The hair styling device of claim 1, wherein the second arm which is adjustable relative to the first arm carrying the non-heated hair support has an outer side suitable for shaping a strand of hair into a curl or wave.

6. The hair styling device of claim 1, wherein the hair styling device has a fan to create a current of air directed at the hair being cooled.

7. The hair styling device of claim 1, wherein the two shaping surfaces of the first arm having the arm support are the shaping surfaces of two heated shaping plates separated by the vertex of the arm support.

* * * * *